United States Patent [19]

Walser

[11] 4,431,384

[45] Feb. 14, 1984

[54] FOOD PUMP

[75] Inventor: Glenn E. Walser, Lubbock, Tex.

[73] Assignee: Automated Food Systems, Inc., Duncanville, Tex.

[21] Appl. No.: 383,482

[22] Filed: Jun. 1, 1982

[51] Int. Cl.[3] ..... F04B 49/00

[52] U.S. Cl. ..... 417/360; 417/403; 417/454; 417/519; 92/128; 137/625.24; 251/214

[58] Field of Search ..... 417/454, 519, 360, 403, 417/404, 900, 401, 338; 92/128; 251/214, 312; 137/625.24

[56] References Cited

U.S. PATENT DOCUMENTS

| | | | |
|---|---|---|---|
| 1,966,498 | 7/1934 | Gross | 92/128 X |
| 2,702,409 | 2/1955 | Loomis | 100/96 X |
| 2,957,430 | 10/1960 | Naef | 417/403 X |
| 3,227,325 | 1/1966 | Bates | 417/519 X |
| 3,350,190 | 10/1967 | Piel | 417/403 X |
| 3,776,667 | 12/1973 | Berglund et al. | 417/454 |
| 3,874,825 | 4/1975 | Jentsch | 417/519 |
| 4,358,257 | 11/1982 | Seiler et al. | 417/519 X |

*Primary Examiner*—Leonard E. Smith
*Attorney, Agent, or Firm*—Wendell Coffee

[57] ABSTRACT

A reciprocating food pump for pumping viscous edible material has the cylinder removably clamped to a base plate. The piston of the pump cylinder is actuated by a reciprocating, compressed air motor having a common piston rod connecting the air piston and pump piston. The air cylinder is pivoted to the base plate so that the pump cylinder may be unclamped from the base plate and moved upwards sufficiently to pull the cylinder away from the piston. A rotating plug valve is used on the end of the pump cylinder. The plug is held in place by a stem extending through a flat valve plate. A seal is placed between a sleeve on the end of the valve stem and the valve plate and another seal between the valve stem and the sleeve. Upon each suction stroke of the pump, the vacuum within the pump pulls the valve plug within the cylinder, which will be transmitted to the stem, and increase the pressure between the sleeve and the flat valve plate insuring a good seal upon each suction stroke. Also, the valve can be disassembled by pulling the pin from the valve stem and pulling the plug out through the cylinder.

10 Claims, 6 Drawing Figures

FOOD PUMP

BACKGROUND OF THE INVENTION (1) Field of the Invention

This invention relates to pumping viscous, edible material with a fluid motor operated pump having a rotating plug valve for opening and closing the intake and outlet port of the pump.

(2) Description of the Prior Art

In the food industries, it is often desirable to pump viscous, edible materials, for example, moving of dough, soup, batter or the like. It has been found desirable to do this with reciprocating pumps and using a rotating plug valve to connect the pump cylinder to its intake and outlet port. Examples of such pumps are MOJONNIER ET AL U.S. Pat. No. 1,794,388, KERR U.S. Pat. No. 3,096,914 and AUSTIN ET AL U.S. Pat. No. 3,385,479.

Before this application was prepared, applicant caused a search to be made in the U.S. Patent and Trademark Offices. In addition to the above patents, the following patents were reported:

JEFFREY U.S. Pat. No. 1,719,806
LOOMIS U.S. Pat. No. 2,702,409
NORMAN U.S. Pat. No. 2,896,257
KELLEY U.S. Pat. No. 3,379,143
McARTHUR U.S. Pat. No. 4,170,253
COLOSIMO U.S. Pat. No. 4,293,979
PERSSON U.S. Pat. No. 4,302,173

These patents do not appear pertinent to the applicant. They are called to the attention of the Examiner since the applicant believes they would be of interest to the Examiner inasmuch as an experienced searcher reported them upon the search.

When a pump is used to pump food it is necessary at the end of each days work, that the pump be cleaned. The more completely the pump is disassembled, the better it can be cleaned. Although this is a recognized objective for food handling equipment, the prior art devices have not always had pumps which were readily and easily disassembled.

In pumping a viscous material, difficulty is experienced with the seals at the pump piston and with the seals of the valves. More difficulty is experienced on the suction stroke than on the pressure stroke. When a charge of viscous material is being drawn into the pump on the suction stroke, problems exist with the air being sucked into the cylinder. This reduces the efficiency of the pump drastically. This makes the design of a pump for viscous, edible material even more difficult. Not only must the seals withstand a vacuum, the pump must be disassembled readily.

SUMMARY OF THE INVENTION (1) New and Different Function

I have solved the problem of producing a pump for viscous, edible materials which is both quickly and completely disassembled for purposes of cleaning and also which has effective seals to maintain a high vacuum upon the suction stroke.

The disassembly of the piston and cylinder is accomplished by having the cylinder latched or clamped to a base plate. The air piston or motor is permanently mounted to the base plate, but pivoted thereto. It is common in the food industry to use conduits or pipes which have quick disconnect couplings at every joint so that the pipes can be removed from the food pump cylinder and they themselves be cleaned. The food pump cylinder is unlatched from the base plate and pivoted upward so that the cylinder is free of the base plate. Then the cylinder is pulled from the piston.

The valve has a plug valve co-axial with the cylinder. The valve has a stem which extends outside of a valve plate. A sleeve around the stem has an O-ring seal between the stem and sleeve. There is another O-ring seal between the end of the seal and the valve plate.

A pin in the end of the stem holds the assembly in place during operation. To disassemble, the pin is removed and the plug valve removed from the cylinder. Thus the pump is completely disassembled and each element (except the O-rings) is disassociated, detached, or disassembled from each of the other elements.

Also, analysis of the design would show that on each suction stroke the vacuum within the cylinder will pull the plug toward the cylinder thus increasing the pressure upon the seal between the sleeve and the valve plate.

Thus it may be seen that the function of the total combination far exceeds the sum of the functions of each individual element such as O-rings, pivots, latches, etc.

(2) Objects of this Invention

An object of this invention is to pump viscous, edible material.

Another object is to provide a pump for pumping viscous, edible material which may be quickly and completely disassembled for thorough cleaning.

Further objects are to achieve the above with a device that is sturdy, compact, durable, lightweight, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENTS

Figure 1:
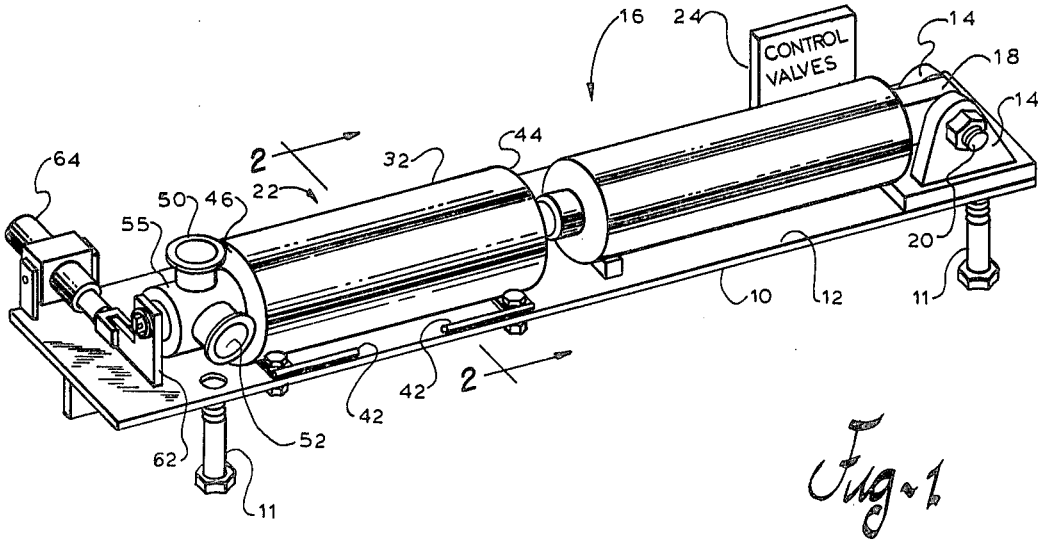
FIG. 1 is a perspective view of a first embodiment of my invention, with some parts schematically represented.
Figure 2:
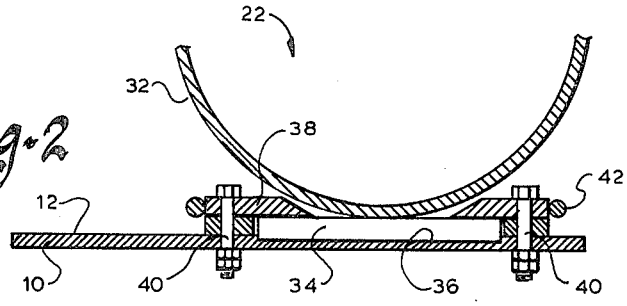
FIG. 2 is a sectional view through one of the clamps taken substantially along line 2—2 of FIG. 1.
Figure 3:
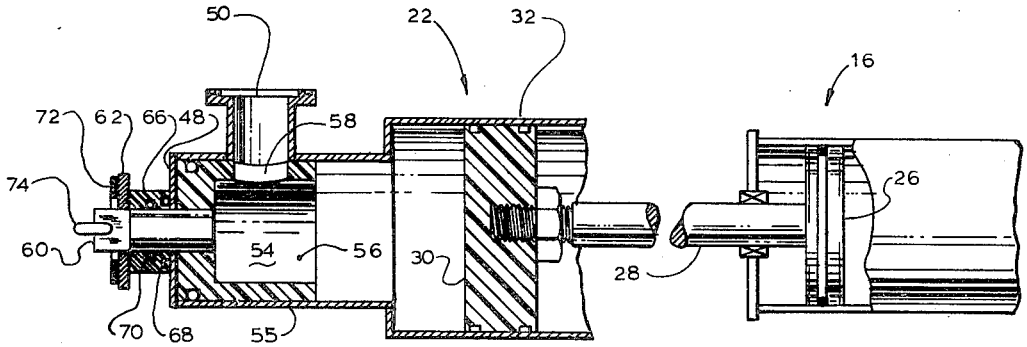
FIG. 3 is an axial sectional view of the valve of FIG. 1.

Referring to the drawings and more particularly to FIG. 1, it may be seen that the pump is basically built upon the base plate 10 having a top surface 12. The base is supported by legs 11.

The base plate 10 includes projecting upward therefrom, a pair of ears 14. A motor means 16 is mounted with a blade 18 between the ears 14. Pin 20 extends through the ears 14 and blade 18 to pivot the motor means 16 to the base plate 10. The entire operation of the air cylinder or motor means 16 and the pump 22 is controlled by control valves 24, which are also mounted upon the base plate 10. Inasmuch as the operation of control valves are well-known (see for example AUSTIN ET AL U.S. Pat. No. 3,385,479) they are only schematically shown and the description of their operation is not repeated here.

The air pressure from the control valves 24 will cause motor piston 26 to reciprocate within the motor means 16. Piston rod 28 is connected both to motor piston 26 and pump piston 30. Therefore, the air cylinder or motor means 16 forms a means on the rod 28 for reciprocating the rod. Also it may be seen, that unless the pump piston 30 is restrained, that the motor means 16 may be pivoted away from the top surface 12 of the base plate 10.

Pump cylinder 32 has feet or lugs 34 welded thereto. The feet 34 fit snugly within grooves 36 cut into the top surface 12 of the base plate 10. Each end of each of the two feet 34 are clamped in place by latch bar 38 which is journaled about pivot pin 40 which extends perpendicular from the top surface 12. The latch bars 38 have an actuating handle 42 thereon. It may be readily seen that the latch bar 38 may be rotated by the handle 42 to either securely clamp the pump cylinder 32 in place or release it. It may be seen that the pump cylinder and air cylinder are coaxial when the pump cylinder is clamped to the base plate 10. The cylinder would be clamped in place for operation, and released so that it might be raised and the cylinder 32 pulled free of the piston 30, thereby disassembling the pump cylinder from the pump piston for thorough cleaning.

The pump cylinder 32 has two ends, a motor end 44 and a valve end 46.

Valve housing 55 is coaxial with the pump cylinder 22 and attached thereto. The valve housing 55 has an inlet port 50 and an outlet port 52 displaced 90° therefrom. Valve plug 54 has an axis and is mounted for rotation within the valve housing 55 coaxial therewith. The plug has an axial cavity 56 and a radial cavity 58. The plug is rotatably mounted within the valve housing 55 so that the radial cavity 58 may be aligned with either the inlet port 50 or the outlet port 52.

Valve stem 60 is coaxial with the plug 54 and securely attached thereto. Near the distal end of the valve stem 60 it is noncircular in cross section and fitted with actuating arm 62. The actuating arm 62 is actuated by control motor 64 which is also controlled from control valve 24. The control valves and the control motor will rotate the valve plug 54 so that the radial cavity 58 is aligned with the inlet port 50 upon the suction stroke and aligned with the outlet port 52 on the pressure stroke, all as is well-known to the art.

The valve stem 60 extends through an axial opening in the valve plate 48. Tubular seal sleeve 66 is telescoped over the stem 60 outside the valve plate 48. The sleeve has a seal end and an arm end. The seal end contains O-ring 68, which forms a seal between the sleeve 66 and the valve plate 48. Stem O-ring 70 forms a stem seal in the sleeve 66 between the stem and the sleeve. The arm 62 contacts the arm end of the sleeve 66. Washer 72 contacts the arm and pin 74 diametrically through the stem 60, holds the washer 72 snugly against the arm which is held snugly against the sleeve 66 which is snug against the valve plate 48.

Upon the suction stroke of the pump 22, the vacuum within the pump cylinder 32 will pull the plug 54 inward. This force will be transmitted through the stem 60, pin 74, washer 72, arm 62, and sleeve 66 so that on the suction stroke, the pressure between the sleeve 66 and the flat valve plate 48 is increased.

To disassemble the valve, the pin 74 is pulled, the washer 72, arm 62, and sleeve 66 are pulled off the stem and the stem and plug 54 are removed through the cylinder.

Figure 4:
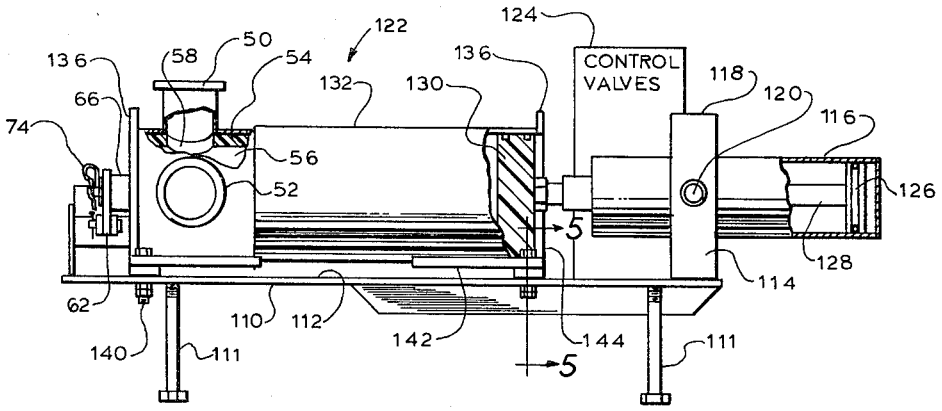
FIG. 4 is a side elevational view of a second embodiment of my invention with some parts broken away for clarity, and other parts schematically represented.
Figure 5:
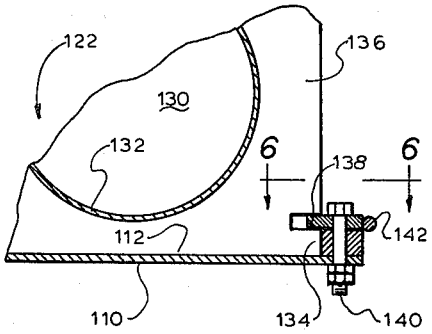
FIG. 5 is a sectional view through one of the clamps taken substantially along line 5—5 of FIG. 4.
Figure 6:
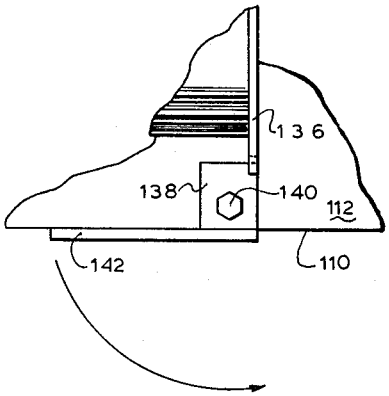
FIG. 6 is a partial top elevational view of one of the clamps taken substantially along line 6—6 of FIG. 5.

Referring to the second embodiment as shown in FIGS. 4, 5, and 6, it may be seen that there are many common parts or quite similar parts. Specifically, the unit is built on a base plate 110 having a top surface 112. Motor means 116 has a trunnion ring 118 clamped around it. Trunnions 120 extend up from the trunion ring 118 and are journaled within the ears 114. The motor piston 126 is connected by piston rod 128 to pump piston 130 within the pump cylinder 132 of the pump 122. The operation of the pump 122 and the control motor 164 is controlled by control valves 124.

The base 110 is supported by legs 111.

Rectangular mounting plates 136 have circular openings therethrough so that they may be mounted coaxially upon the motor end 144 of the pump cylinder 132. The bottom of the mounting plate is notched to form toes or lugs 134. Latch bar 138 is journaled to pivot pin 140 projecting perpendicular from the top surface 112. The latch bar 138 may be actuated by the handle 142 to engage the notches or to hold the lugs 134 securely against the base plate 110.

The valve is identical to the valve described for the first embodiment, even in size. The pump cylinder 132 is of smaller diameter and length for the second embodiment, and therefore the pump capacity is much smaller. In fact, on the second embodiment the pump cylinder 132 will have about the same diameter as the valve housing 55.

A mounting plate 136 is mounted over the valve plate of the valve housing 55. This mounting plate is also clamped to the base plate 110. Therefore it may be seen, that each embodiment achieves the objective of this invention of making a pump which is efficient and has good air seals to prevent air from being sucked into the cylinder upon the suction stroke and which is very easily and completely disassembled for thorough cleaning.

The embodiments shown and described above are only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific examples above do not point out what an infringement of this patent would be, but are to enable the reader to make and use the invention.

As an aid to correlating the terms of the claims to the exemplary drawing, the following catalog of elements is provided:

| | | | |
|---|---|---|---|
| 10 | base plate | 62 | actuating arm |
| 11 | legs | 64 | control motor |
| 12 | top surface | 66 | sleeve |
| 14 | ears | 68 | O-ring |
| 16 | motor means | 70 | stem O-ring |
| 18 | blade | 72 | washer |
| 20 | pin | 74 | pin |
| 22 | pump | 110 | base plate |
| 24 | control valves | 111 | legs |
| 26 | motor piston | 112 | top surface |
| 28 | piston rod | 114 | ears |
| 30 | pump piston | 116 | motor means |
| 32 | pump cylinder | 118 | trunnion ring |
| 34 | feet or lug | 120 | trunnions |
| 36 | grooves | 122 | pump |
| 38 | latch bar | 124 | control valves |
| 40 | pivot pin | 126 | motor piston |
| 42 | actuating handle | 128 | piston rod |
| 44 | motor end | 130 | pump piston |
| 46 | valve end | 132 | pump cylinder |
| 48 | valve plate | 134 | toes or lugs |
| 50 | inlet port | 136 | rectangular mounting plates |
| 52 | outlet port | 138 | latch bar |
| 54 | valve plug | 140 | pivot pin |
| 55 | valve housing | 142 | actuating handle |
| 56 | axial cavity | 144 | motor end |
| 58 | radial cavity | 146 | valve end |
| 60 | valve stem | | |

I claim as my invention:

1. The process of pumping a viscous edible product involving a. a pump cylinder having two ends,
b. a pump piston in the cylinder,
c. a piston rod on the piston,
d. a valve on one end of the cylinder, and
e. motor means on the rod at the other end of the cylinder for reciprocating the rod in the cylinder;

wherein the improved method comprises;

f. unclamping the cylinder from a base plate
g. pivoting the motor means relative to the base plate so that the piston rod is moved in a direction away from the base plate, thus
h. moving the cylinder away from the base plate, then
i. pulling the cylinder from the pump piston, then
j. thoroughly cleaning the pump piston and cylinder while disassembled, thereafter
k. placing the pump cylinder again over the pump piston,
l. rotating the motor means so that the cylinder is against the base plate, and
m. clamping the cylinder to the base plate.

2. The process of pumping a viscous edible material involving a. a pump cylinder having two ends,
b. a pump piston in the cylinder,
c. a piston rod on the piston,
d. motor means on the rod at one end of the cylinder for reciprocating the rod in the cylinder, and
e. a valve on the other end of the cylinder,
f. said valve including
(i) a plug having an axis,
(ii) the plug mounted for rotation in the cylinder about its axis,
(iii) cavities in the plug to selectively open an inlet and an outlet into the cylinder, and
(iv) a valve stem co-axial with the plug;

wherein the improved method comprises:

g. extending the valve stem through a valve plate,
h. placing a tubular seal sleeve over the stem outside the valve plate,
j. placing one end of the sleeve against the valve plate, thus forming a seal between the sleeve and valve plate,
k. sealing the sleeve to the valve stem,
l. pinning an actuating arm and washer to the stem at the end of the stem and against the sleeve,
m. applying a vacuum within the pump cylinder with each stroke of the piston, thus
n. biasing the valve stem toward the valve plate to increase the pressure on the flat seal between the sleeve and the valve plate, and
o. removing the pin, washer, arm, and sleeve from the stem,
p. removing the valve plug from within the cylinder, and
q. thoroughly cleaning the parts.

3. The invention as defined in claim 2 including all the limitations a. through q. with the addition of the following limitations:

r. unclamping the cylinder from a base plate,
s. pivoting the motor means relative to the base plate so that the piston rod is moved in a direction from the base plate, thus
t. moving the cylinder away from the base plate, then
u. pulling the cylinder from the pump piston, then
v. thoroughly cleaning the pump piston and cylinder while disassembled, thereafter
w. placing the pump cylinder again over the pump piston,
x. rotating the motor means so the cylinder is against the base plate, and again
y. clamping the cylinder to the base plate.

4. A pump for viscous material having a. a pump cylinder having two ends,
b. a pump piston in the cylinder,
c. a piston rod on the piston,
d. a valve on one end of the cylinder, and
e. motor means on the rod at the other end of the cylinder for reciprocating the rod in the cylinder;

wherein the improvement comprises, f. a base plate having
g. a top surface,
h. said motor means pivoted to the base plate so that the rod may be moved in a direction away from the top surface, and
i. clamp means on the top surface of the base plate for clamping the cylinder to the base plate,
j. so that the cylinder may be unclamped, raised, separated from the piston and thoroughly cleaned.

5. The invention as defined in claim 4 including all of the limitations a. through j. wherein; said motor means includes:

k. an air cylinder co-axial
l. with said pump cylinder having
m. an air piston connected to said piston rod.

6. The invention as defined in claim 4 including all of the limitations a. through j. wherein said clamp means includes:

k. a latch bar,
l. a pivot pin perpendicular to said top surface,
m. a lug attached to said cylinder,
n. said latch bar journaled on said pivot pin to engage said lug and thus securely clamp said cylinder to said base plate.

7. The invention as defined in claim 6 including all of the limitations a. through n. wherein; said motor means includes:

o. an air cylinder co-axial
p. with said pump cylinder having
q. an air piston connected to said piston rod.

8. A pump for viscous material having a. a pump cylinder having two ends,
b. a pump piston in the cylinder,
c. a piston rod on the piston,
d. motor means on the rod at one end of the cylinder for reciprocating the rod in the cylinder, and
e. a valve on the other end of the cylinder including
(i) a plug having an axis,
(ii) the plug mounted for rotation in the cylinder about its axis,
(iii) cavities in the plug to selectively open an inlet and an outlet into the cylinder, and
(iv) a valve stem co-axial with the plug;

wherein the improvement comprises:

f. a valve plate on the cylinder,
g. said valve stem extending through the valve plate,
h. a tubular seal sleeve telescoped over the stem outside the valve plate,
j. the sleeve having a seal end and an arm end,
k. the seal end of the sleeve forming a flat seal between the sleeve and valve plate,
l. a stem seal in the sleeve between the stem and sleeve,
m. an arm on the stem against the arm end of the sleeve,
n. a washer on the stem against the arm, and
o. a pin through stem holding the washer, arm and sleeve snugly against the valve plate,
p. so that a vacuum within the cylinder pulls the valve plug, valve stem, pin, washer, arm, and sleeve toward the valve plate, thereby increasing the pressure on the flat seal, and
q. so that removal of the pin permits the removal of the washer, arm, and sleeve so that the plug may be removed through the cylinder for thorough cleaning.

9. The invention as defined in claim 8 including all of the limitations a. through q. with the addition of the following limitations:

r. said plug axis co-axial with said pump cylinder, and
s. said valve plate forming an effective terminal to said pump cylinder at the valve end thereof.

10. The invention as defined in claim 8 including all of the limitations a. through q. with the addition of the following limitations:

r. a base plate having
s. a top surface,
t. said motor means pivoted to the base plate so that the rod may be moved in a direction away from the top surface, and
u. clamp means on the top surface of the base plate for clamping the cylinder to the base plate,
v. so that the cylinder may be unclamped, raised, separated from the piston and thoroughly cleaned.

* * * * *